US005604400A

United States Patent [19]

Altmaier et al.

[11] Patent Number: 5,604,400

[45] Date of Patent: Feb. 18, 1997

[54] OVERVOLTAGE PROTECTION ELEMENT

[75] Inventors: Holger Altmaier, Steinheim; Klaus Scheibe; Eberhard Lehmann, both of Kiel; Gerhard Oertel, Blomberg, all of Germany

[73] Assignee: Phoenix Contact GmbH & Co., Germany

[21] Appl. No.: 631,825

[22] Filed: Apr. 10, 1996

Related U.S. Application Data

[63] Continuation of Ser. No. 251,759, May 31, 1994, abandoned.

[30] Foreign Application Priority Data

Jan. 28, 1994 [DE] Germany ..... 44 02 615.3
May 31, 1994 [DE] Germany ..... 43 17 933.9

[51] Int. Cl.[6] ..... H01T 4/14

[52] U.S. Cl. ..... 313/621; 313/231.21; 361/120; 337/28

[58] Field of Search ..... 313/231.11, 231.21, 313/231.41, 621, 620; 361/120, 220, 137; 337/28, 22

[56] References Cited

U.S. PATENT DOCUMENTS

| | | | |
|---|---|---|---|
| 1,144,029 | 6/1915 | Creighton | 361/120 |
| 3,780,350 | 12/1973 | Sanger et al. | 361/120 |
| 3,795,840 | 3/1974 | Cambra | 317/16 |
| 4,100,588 | 7/1978 | Kresge | 361/127 |
| 4,249,224 | 2/1981 | Baumbach | 361/124 |
| 4,345,295 | 8/1982 | Hasse et al. | 361/130 |
| 4,366,523 | 12/1982 | Hasse et al. | 361/120 |
| 4,385,338 | 5/1983 | Hasse et al. | 361/120 |
| 4,433,354 | 2/1984 | Lange et al. | 361/120 |

FOREIGN PATENT DOCUMENTS

| | | | |
|---|---|---|---|
| 2718188 | 1/1980 | Germany | H01T 1/14 |
| 2934236 | 3/1981 | Germany | H01T 5/00 |
| 3101354 | 11/1984 | Germany | H10T 3/00 |
| 3716997 | 5/1990 | Germany | H01T 4/02 |
| 4141681 | 7/1993 | Germany | H01T 4/10 |
| 4141682A1 | 7/1993 | Germany | H01T 4/10 |
| 4244051A1 | 7/1994 | Germany | H01T 1/20 |

*Primary Examiner*—Michael Horabik
*Assistant Examiner*—Michael Day
*Attorney, Agent, or Firm*—Sixbey, Friedman, Leedom & Ferguson, P.C.; David S. Safran

[57] ABSTRACT

An overvoltage protection element for discharging transient overvoltages, with two electrodes (2), a disruptive discharge-spark air between the electrodes (2) and a housing (4) containing the electrodes (2). Each electrode (2) has a connecting leg (5) and an arcing horn (6) which runs at an acute angle relative to the connecting leg (5). The disruptive discharge-spark air gap is formed by facing surfaces of the arcing horns (6) of the electrodes (2), which are spaced from one another. In preferred embodiments, the arcing horns (6) of the electrodes (2), in their areas near the connecting leg (5), are provided with at least one hole (7) running therethrough which, preferably, has a diameter that is less than 2 mm.

26 Claims, 4 Drawing Sheets

FIG. 1
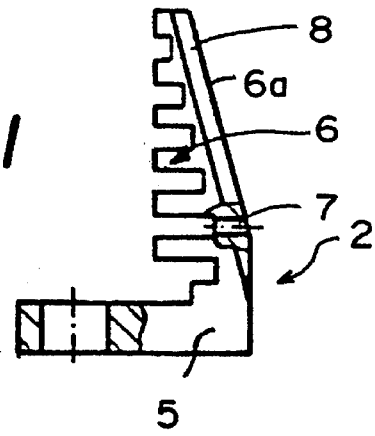
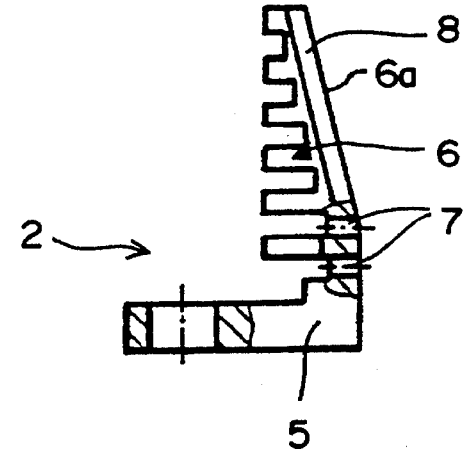
FIG. 2
FIG. 3
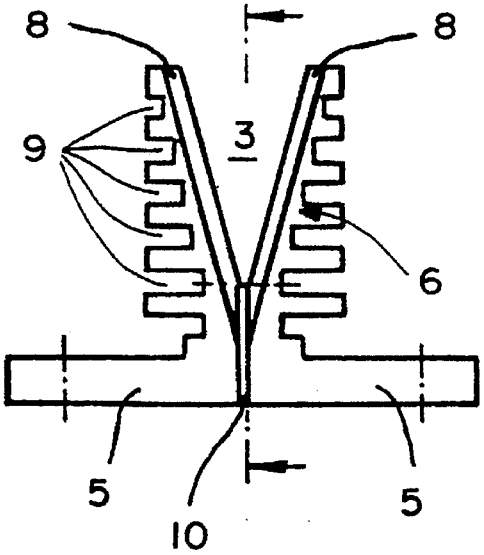
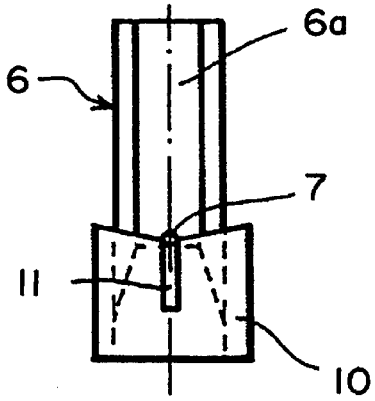
FIG. 4

OVERVOLTAGE PROTECTION ELEMENT

This application is a continuation, of application Ser. No. 08/251,759, filed May 31, 1994, now abandoned.

BACKGROUND OF THE INVENTION

1. Field of the Invention

The invention relates to an overvoltage protection element for discharging transient overvoltages, with two electrodes, one disruptive discharge-spark gap which is active in air between the electrodes and a housing containing the electrodes, each electrode having a connecting leg and an arcing horn running at an acute angle to the connecting leg and the arcing horns of both electrodes, which are spaced from each other, forming the disruptive discharge-spark air gap.

2. Description of Related Art

Electric, in particular electronic, measuring, control, regulator, and switching circuits, also especially telecommunications devices and systems, are sensitive to transient overvoltages, as they can occur in particular due to atmospheric discharges, but also due to short circuits and switching operations in power supply systems. This sensitivity is increased to the degree that electronic components, in particular transistors and thyristors, are used; above all, increasingly used integrated circuits are endangered to a high degree by transient overvoltages.

Besides the overvoltage protection element on which the invention is based (see German Patent 37 16 997), i.e., one with a disruptive discharge-spark air gap, there are overvoltage protection elements with a flashover-spark gap in air in which, e.g., during sparkover, a creeping discharge occurs (see German Patents 27 18 188 and 31 01 354 and German Application DE 29 34 236 A1).

Overvoltage protection elements of the type to which the present invention is directed, i.e., those with a disruptive discharge-spark air gap, have, compared to overvoltage protection elements with a flashover-spark air gap, the advantage of higher surge withstanding strength, but the drawback of a higher, and also not particularly constant, sparkover voltage.

Various overvoltage protection elements have already been developed with a disruptive discharge-spark air gap that have been improved with respect to the sparkover voltage (see DE-A-41 41 681, DE-A-41 41 682 and DE-A-42 44 051).

SUMMARY OF THE INVENTION

Thus, the primary object of the present invention is to improve an overvoltage protection element of the initially-mentioned type with respect to its overvoltage protection behavior, as well as with respect to the sparkover voltage, the carrying capacity behavior when there is lightning surge current and network follow current, and the extinction behavior when there is network follow current.

The object indicated above is achieved by various teachings according to the invention, and these teachings can be used alternatively, but above all also cumulatively.

A primary teaching according to the invention is that, first and foremost, the arcing horns of the electrodes, in their areas adjacent to the connecting legs, are provided with a hole running through each of the connecting legs. These holes make sure that, at the moment of sparkover of the overvoltage protection element, improved ignition and are running behavior is introduced. In particular, the arc next to the holes "is set in motion" by a thermal-atmospheric blow-out.

A second teaching according to the invention is that, between the opposite ends of the connecting legs of both electrodes, an ignition aid that triggers a creeping discharge is provided. In the overvoltage protection element designed according to this teaching, there is integrated, virtually at the narrowest part of the disruptive discharge-spark air gap, i.e., where a sparkover takes place, an auxiliary flashover-spark air gap. The integrated auxiliary flashover-spark air gap has a relatively constant and, above all, lower sparkover voltage than the disruptive discharge-spark air gap used for the actual overvoltage protection. Once sparked over, at a relatively constant, low sparkover voltage, the ignited auxiliary flashover-spark air gap leads to a "sudden" ignition of the disruptive discharge-spark air gap with relatively high current carrying capacity, i.e., high capacity to carry lightning surge current and network follow current. With this embodiment of an overvoltage protection element according to the invention, the advantages of a disruptive discharge-spark air gap and of a flashover-spark air gap are realized and their drawbacks eliminated.

A further teaching according to the invention is that the housing is at least partly comprised of a plastic that releases no carbon if it burns, or at least is partly lined with such a plastic. Normally, it is problematic to install electrodes, with arcing horns, that form a disruptive discharge-spark air gap in a relatively small housing made of plastic that releases carbon when heated or burned. In particular, because of the very hot are produced after sparkover, a burning of the plastic results and thus an enormous release of carbon. This leads to contamination of the electrodes and insulation resistance is no longer available. Further, the enormous carbon amount in the gas mixture impairs the extinguishing behavior of the electrodes. The above-described drawbacks naturally do not occur when, according to the invention, the housing is formed at least partly of a plastic that releases no carbon when heated or burned, or when the housing is at least partly lined with such a plastic.

Another teaching according to the invention is that the side walls of the housing are placed relatively near the arcing horns of the electrodes. This teaching results in an extraordinarily good atmospheric blow-out of the arc. It runs very quickly at the tips of the arcing horns, i.e., does not jam in the ignition area.

An additional teaching according to the invention is that the housing cover adjacent to the arcing horns of the electrodes is made of an electrically conductive material, preferably of copper-tungsten, and then, generally the distance between the ends of the arcing horns of the electredes, adjacent to the housing cover, and the housing cover, is selected so that, between the ends of the arcing horns adjacent to the housing cover and the housing cover, arcs can arise. With this overvoltage protection element according to the invention, the are first creeps out of the ignition area at the tips of the arcing horns. Then, two arcs are formed between the tips of the arcing horns and the housing cover of electrically conductive material. The conductor loops thus formed ensure that both arcs are driven behind the arcing horns. This results in the formation of two arcs that provide, overall, for an enormously high arc-drop voltage which produces an extinction behavior in the nature of a quasi-short circuit resistant discharge path. Since both arcs are located behind the arcing horns, the sensitive ignition area between the arcing horns is extraordinarily well protected.

These and further objects, features and advantages of the present invention will become apparent from the following description when taken in connection with the accompanying drawings which, for purposes of illustration only, show several embodiments in accordance with the present invention.

BRIEF DESCRIPTION OF THE DRAWINGS

FIG. 1 is a side view of a preferred first embodiment of an electrode of an overvoltage protection element according to the invention;

FIG. 2 is a side view of a preferred second embodiment of an electrode of an overvoltage protection element according to the invention;

FIG. 3 is a side view of two interacting electrodes according to FIG. 1;

FIG. 4 is a section through the electrodes according to FIG. 3 along line 4—4;

Figure 5:
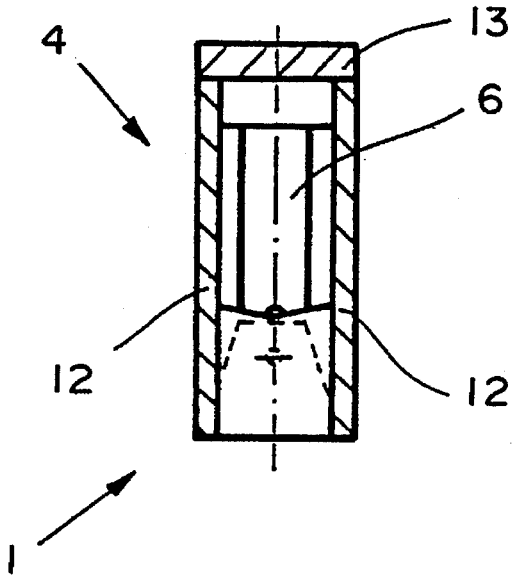
FIG. 5 is a cross-section through a preferred embodiment of an overvoltage protection element according to the invention represented diagrammatically.

DETAILED DESCRIPTION OF THE PREFERRED EMBODIMENT.

Overvoltage protection element 1 according to the invention, represented in FIGS. 5 and 6 and 7 to 10 is used to discharge transient overvoltages and to limit surge currents, and comprises in its basic design, of two electrodes 2, a disruptive discharge-spark air gap 3 that is active between the electrodes 2, and a housing 4 containing the electrodes 2. Each electrode 2 has a connecting leg 5 and an arcing horn 6 running at an acute angle with respect to connecting leg 5. As FIGS. 1 to 3 and 6 show, the acute angle between connecting leg 5 and arcing horn 6 refers to the operational surface 6*a* of arcing horn 6. Arcing horns 6 of both electrodes 2 are spaced from each other, and together form a disruptive discharge-spark air gap 3. Because arcing horns 6 of electrodes 2 run in the above-explained way at an acute angle relative to connecting legs 5, disruptive discharge-spark air gap 3 is designed as an acute angle; the angle between the spaced facing surfaces of the arcing horns 6, of electrodes 2 is preferably about 30°.

As especially FIGS. 1, 2 and 4 show, arcing horns 6 of electrodes 2, in their areas adjacent to connecting legs 5, are provided with holes 7 running parallel to connecting legs 5, holes that are made in the embodiment centrally in arcing horns 6 of electrodes 2 (see especially FIGS. 4 and 5). Holes 7 have a diameter that is less than 2 mm, in particular, 1.5 mm in arcing horns 6 having a width hat is less than 15 mm, particularly 8 mm.

In electrode 2, represented in FIG. 1, of an overvoltage protection element 1 according to the invention, arcing horn 6 is provided with a single hole 7. In contrast, FIG. 2 shows an electrode 2 in which arcing horn 6 has two superposed holes 7; in comparison with electrode 2 according to FIG. 1, in the electrode according to FIG. 2, another hole 7 is made beneath hole 7 with which electrode 2 according to FIG. 1 is provided.

Holes 7 provided in arcing horns 6 of electrodes 2 of overvoltage protection element 1 according to the invention make sure that, at the moment of sparkover of overvoltage protection element 1, i.e., of ignition, the arc produced next to holes 7 "is set in motion" by a thermal and/or electric and/or magnetic pressure and/or force effect, i.e., creeps away from the point at which it arose.

Further, it can be seen in the figures that, in the embodiment represented, arcing horns 6 of electrodes 2 are provided on both sides in each case with a chamfer 8, are made convex on their sides facing one another producing a laterally outward flaring, and, on their sides facing away from one another, are provided with slits 9 running crosswise to the lengthwise path of arcing horns 6; instead of crosswise-running slits 9 shown, lengthwise-running slits are also possible. The chamfer of arcing horns 6 of electrodes 2 prevents the formation of material deposits at the edges of arcing horns 6. The preferably taken measure of making arcing horns 6 of electrodes 2 convex on their sides facing one another leads to the fact that the arc produced after a sparkover of the overvoltage protection element according to the invention, preferably, is produced centrally in the area of arcing horns 6 and runs centrally to the ends or tips of arcing horns 6. With slits 9, with which arcing horns 6 of electrodes 2 are provided on their sides facing away from one another, it is finally achieved that the current must exactly trace the contour of the V-shaped disruptive discharge-spark air gap up to the bottom arc of the arc. This results, at opposite electrode 2, in a magnetic blow-out of the arc at its base. Besides, slits 9 have the advantage that the remaining material functions as an especially effective cooling element; thus, there is simultaneously a ventilation of arcing horns 6 of electrodes 2 from behind.

In the embodiment of an overvoltage protection element 1 according to the invention represented in the figures, there is provided, between the opposite ends of connecting legs 5 of both electrodes 2, an ignition aid 10 that triggers a creeping discharge. Preferably, ignition aid 10 is formed of an insulating material which, when there is a change of state, for example, a heating, does not release carbon to a degree that impairs operation (e.g., polyoxymethylen (POM)) and projects slightly, preferably 0.1 mm or more, into disruptive discharge-spark air gap formed by arcing horns 6 of electrodes 2; in fact, ignition aid 10 projects into disruptive discharge-spark air gap as far as into the center of holes 7. Further, ignition aid 10, as FIGS. 4 and 5 show it, is V-shaped so as to be recessed on its side facing disruptive discharge-spark air gap and is provided with a narrow slit 11 which positively influences the sparkover voltage.

In the represented embodiment of an overvoltage protection element 1 according to the invention, because of the above-described measures, an auxiliary flashover-spark air gap is virtually integrated in the narrowest part of disruptive discharge-spark air gap 3, i.e., where a sparkover or ignition takes place. This integrated auxiliary flashover-spark air gap has a relatively constant and, above all, lower sparkover voltage than disruptive discharge-spark air gap 3 used for the actual overvoltage protection. Once sparked over, at a relatively constant, low sparkover voltage, the ignited auxiliary flashover-spark air gap leads to a "sudden" ignition of disruptive discharge-spark air gap 3 at a relatively high current carrying capacity.

FIGS. 5 and 6, and 7 to 10 show that, in the represented embodiment of an overvoltage protection element 1 according to the invention, special measures also are taken with respect to housing 4. In fact, housing 4 is partly formed of a plastic, e.g., POM, that releases no carbon when heated or burned, or is partly lined with such a plastic, which is not represented. The previously described problems that occur when the housing is formed of a plastic that releases carbon when heated or burned, are thus eliminated.

Further, FIGS. 5 and 6, and 7 to 10 show that, in the represented embodiment of an overvoltage protection element 1 according to the invention, walls 12 of housing 4 are placed right next to arcing horns 6 of electrodes 2. This produces an extraordinarily good running behavior of the arc; it runs very quickly to the tips of the arcing horns.

Figure 6:
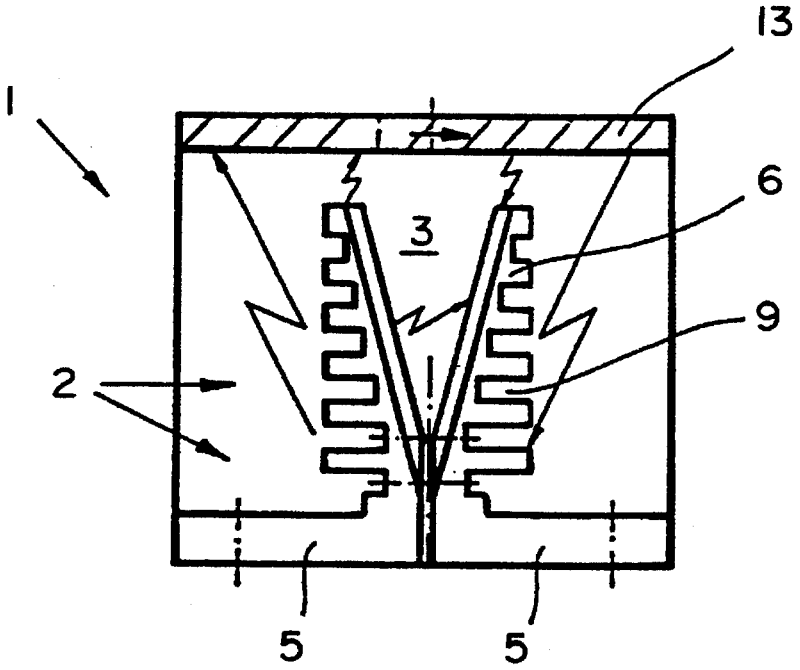
FIG. 6 is a lengthwise section through the overvoltage protection element according to FIG. 5.

For the embodiment represented in FIGS. 5 and 6 of an overvoltage protection element 1 according to the invention, housing cover 13, adjacent to arcing horns 6 of electrodes 2, is formed of an electrically conductive material, preferably of an erosion resistant material, in particular of copper-tungsten. Here, the distance between the ends of arcing horns 6 of electrodes 2, which are adjacent to housing cover 13 and housing cover 13 is selected so that arcs can arise between housing cover 13 and the ends of arcing horns 6 which are adjacent to housing cover 13. Because of the measures described further above, the arc produced after the sparkover of overvoltage protection element 1 according to the invention creeps first out of the ignition area at the tips of arcing horns 6. Then, two arcs form between the tips of arcing horns 6 and housing cover 13 made of electrically conductive material. The conductor loop formed in this process now provides that both arcs are driven behind arcing horns 6. This has the overall result that two arcs are formed that provide, overall, for an enormously high arc-drop voltage which produces an extinction behavior in the nature of a quasi-short circuit resistant discharge arrangement.

It should still be pointed out that, in the embodiment of an overvoltage protection element 1 according to the invention, to which an electrode according to FIG. 2 belongs, i.e., one in which each arcing horn 6 has two superposed holes 7, the second, lower hole 7 becomes active when ignition aid 10 between connecting legs 5 of electrodes 2 has burned down. Second hole 7 thus is used as a quasi-assurance that overvoltage protection element 1 according to the invention functions also in such a case.

While a preferred embodiment of an overvoltage protection element 1 according to the invention is represented only diagrammatically in FIGS. 5 and 6, FIGS. 7 to 10 show, in structural detail, such a preferred embodiment of an overvoltage protection element 1 according to the invention. Here, let it be first pointed out that, in FIGS. 1 to 6, electrodes 2 are represented so that disruptive discharge-spark air gap 3 opens from the bottom toward the top. In contrast, in the embodiment represented in FIGS. 7 to 10, also with respect to structural detail, electrodes 2 are arranged so that disruptive discharge-spark air gap 3 opens from the top toward the bottom. Further, in the embodiment of an overvoltage protection element 1 according to the invention represented in detail in FIGS. 7 to 10, the elements essential for its operation, i.e., electrodes 2 with arcing horns 6 and ignition aid 10, are basically designed as it has been described above in detail in connection with FIGS. 1 to 6, so that discussion of these aspects are superfluous in connection with FIGS. 7 to 10. FIGS. 7 to 10 thus show, above all, structural details with respect to housing 4.

Figure 7:
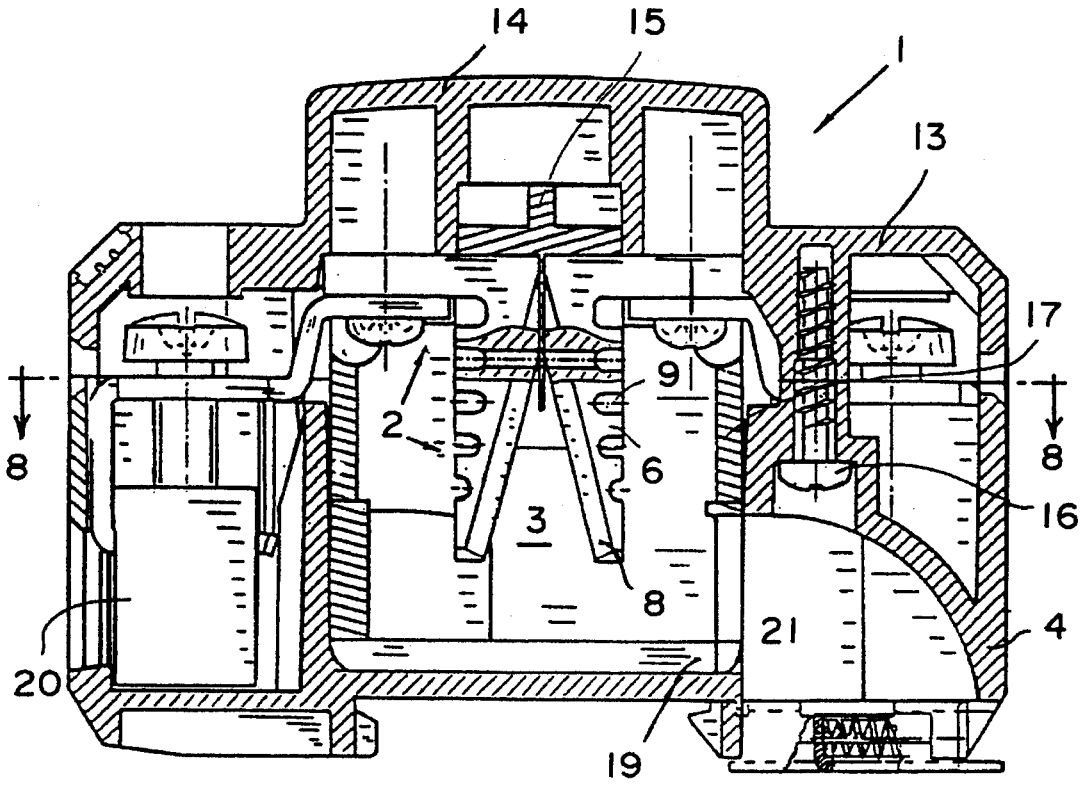
FIG. 7 is a lengthwise section taken along line 7—7 of FIG. 8 through a preferred embodiment of an overvoltage protection element according to the invention represented in detail.
Figure 10:
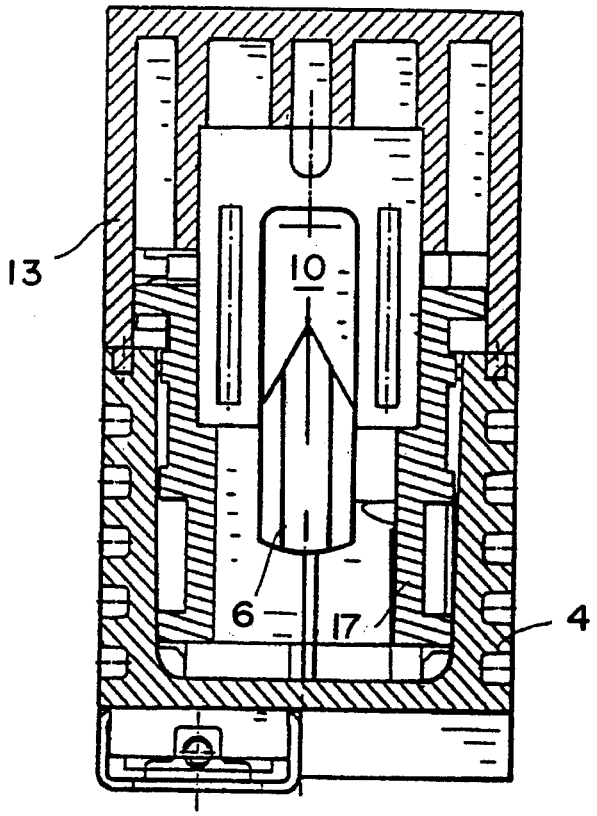
FIG. 10, a section through the overvoltage protection element according to FIG. 7 (along line 10—10 in FIG. 8).

As FIGS. 7 and 10 show, a specially configured housing cover 13 is provided for housing 4. This housing cover 13 has a dome-like shape 14 into which a support 15 receiving electrodes 2 is inserted. Housing cover 13 is connected by interior screws 16 to actual housing 4.

Further above it was explained that housing 4 consists at least partly of a plastic that, when heated or burned, releases no carbon or at least is partly lined with such a plastic, e.g., POM. In the embodiment represented in FIGS. 7 to 10, the second of these alternatives has been implemented; housing 4, thus, has a lining 17 made of a plastic that releases no carbon when heated or burned.

In connection with FIGS. 5 and 6 it was explained further above that side walls 12 of housing 4 come fight up to arcing horns 6 of electrodes 2, producing an extraordinarily good running behavior of the arc. The embodiment represented in structural detail in FIGS. 7 to 10 of an overvoltage protection element 1 according to the invention achieves the same good running behavior of the arc, instead by providing delimiting elements 18 on the side of the disruptive discharge-spark air gap 3 formed by arcing horns 6. That is, as shown in FIG. 3, delimiting elements 18 laterally close the air gap 3 and limit lateral expansion of the arc between the horns 6.

In connection with FIGS. 5 and 6 it was also explained above that housing cover 13 adjacent to arcing horns 6 of electrodes 2 is formed of electrically conductive material, and the distance between the ends of arcing horns 6 of electrodes 2, which are adjacent to the housing cover 13 and housing cover 13 is selected so that arcs can be produced between the ends of arcing horns 6 which are adjacent to housing cover 13 and the housing cover 13. The same result is achieved in the embodiment represented in FIGS. 7 to 10 by providing, in housing 4, opposite the ends of arcing horns 6 of electrodes 2, a lining 19 of electrically conductive material, and preferably are that which is also erosion-resistant.

Figure 8:
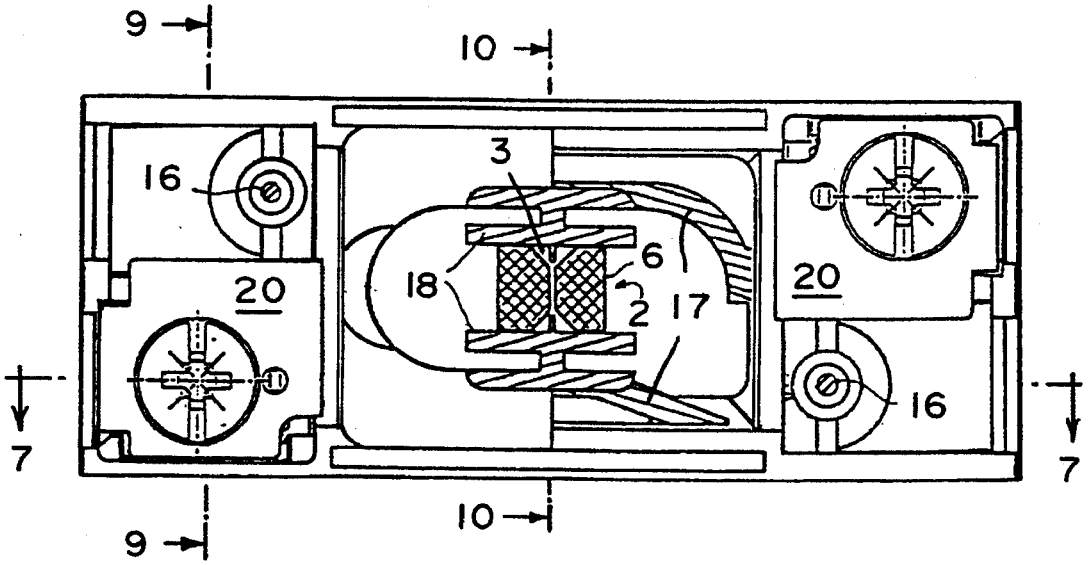
FIG. 8 is a top view of the overvoltage protection element according to FIG. 7, partly in section taken along line 8—8 of FIG. 7.
Figure 9:
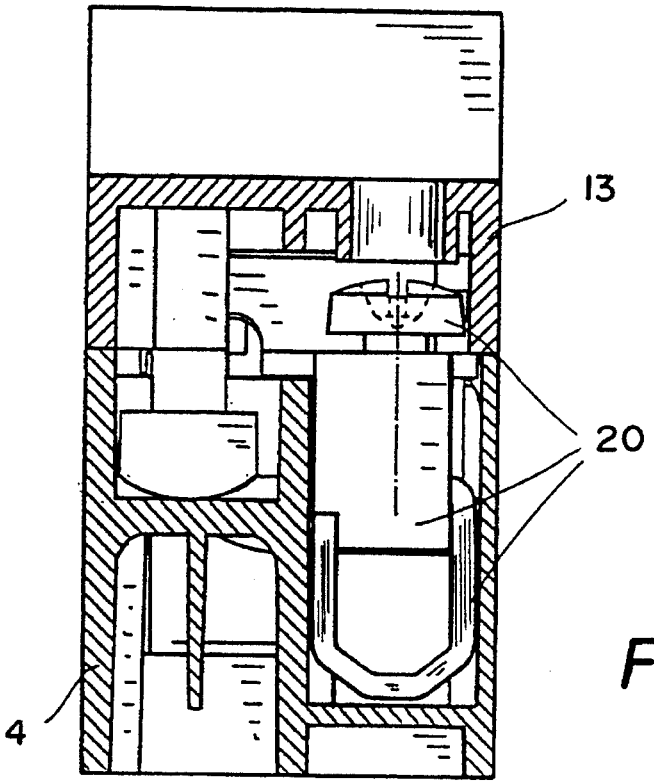
FIG. 9 is a section through the overvoltage protection element according to FIG. 7 (along fine 9—9 in FIG. 8)

Further, FIGS. 7 to 10 show, especially FIGS. 7 to 9, that housing 4, and consequently also housing cover 13, are made unsymmetrical. That is, as can be seen from FIG. 8, location of screws 16 by which housing cover 13 is connected to housing 4 and of connecting elements 20 for connecting electric lines (not shown) are reversed on one side of the central vertral plane represented by line 10—10 as compared to that on the other side of that plane. Arcing openings 21 are made beneath screws 16 with which housing cover 13 is connected to housing 4.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

We claim:

1. In an overvoltage protection element for discharging transient overvoltages of the type in which a disruptive discharge-spark air gap is active between two electrodes contained in a housing, each electrode being essentially L-shaped having a connecting leg and an arcing horn running at an acute angle to the connecting leg, and the arcing horns of the electrodes having spaced facing surfaces between which the disruptive discharge-spark air gap is formed and the connecting legs of the electrodes being directed away from each other, the improvement wherein the arcing horn of each electrode is provided with at least one hole running therethrough in an area close to the connecting leg and and parallel to said connecting leg as a means for setting in motion an arc produced next to said at least one hole.

2. Overvoltage protection element according to claim 1, wherein said at least one hole has a diameter of less than 2 mm.

3. Overvoltage protection element according to claim 2, wherein said at least one hole has a diameter of approximately 1.5 mm.

4. Overvoltage protection element according to claim 1, wherein an angle is formed between facing surfaces of the arcing horns, said angle being approximately 30°.

5. Overvoltage protection element according to claim 1, wherein the arcing horns have a width of less than 15 mm.

6. Overvoltage protection element according to claim 5, wherein the arcing horns have a width of approximately 8 mm.

7. Overvoltage protection element according to claim 1, wherein said at least one hole runs parallel to the connecting legs.

8. Overvoltage protection element according to claim 7, wherein said at least one hole is located in a longitudinal center plane of the arcing horns.

9. Overvoltage protection element according claim 1, wherein the at least one hole in the arcing horn of each electrode comprises a pair of superposed holes.

10. Overvoltage protection element according to claim 1, wherein the facing surfaces of the arcing horns flare laterally outwardly with respect to a longitudinal center plane of the arcing horns.

11. Overvoltage protection element according to claim 10, wherein the laterally outward flaring of the arcing horns of the electrodes is due to a convex curvature of the facing surfaces thereof.

12. Overvoltage protection element according to claim 1, wherein surfaces of the arcing horns of the electrodes facing away from each other are provided with slits.

13. Overvoltage protection element according to claim 12, wherein said slits extend crosswise to a longitudinal extent of the arcing horns.

14. Overvoltage protection element according to claim 1, wherein an ignition aid means for triggering a creeping discharge is provided between facing ends of the connecting legs of the electrodes.

15. Overvoltage protection element according to claim 14, wherein said ignition aid means comprises an insulating material that will not release carbon to a degree impairing operation when heated to a physical state changing temperature.

16. Overvoltage protection element according to claim 14, wherein said ignition aid means projects slightly into the disruptive discharge-spark air gap.

17. Overvoltage protection element according to claim 14, wherein said ignition aid projects to the center of said at least one hole.

18. Overvoltage protection element according to claim 14, wherein said ignition aid means has a side which faces the disruptive discharge-spark air gap and which is recessed.

19. Overvoltage protection element according to claim 14, wherein the ignition aid means is provided with a narrow slit extending into the disruptive discharge-spark air gap.

20. Overvoltage protection element according to claim 1, wherein the housing is made at least partly of a plastic that releases no carbon when heated to a physical state changing temperature.

21. Overvoltage protection element according to claim 20, wherein the housing is at least partly lined with said plastic.

22. Overvoltage Protection element according to claim 20, wherein said plastic is polyoxymethylen.

23. Overvoltage protection element according to claim 1, wherein the housing has side walls which adjoin the arcing horns of electrodes.

24. Overvoltage protection element according to claim 1, wherein the housing is provided with a cover adjacent to the arcing horns of the electrode which is formed of an electrically conductive material.

25. Overvoltage protection element according to claim 24, wherein said cover is formed of copper-tungsten.

26. Overvoltage protection element according to claim 24, wherein ends of the arcing horns of the electrodes nearest the housing cover are positioned at a distance relative to the housing cover which will enable arcing to be produced between the ends of arcing horns and the housing cover.

* * * * *